US006386384B1

(12) United States Patent
Chohfi et al.

(10) Patent No.: US 6,386,384 B1
(45) Date of Patent: May 14, 2002

(54) FULL JACKET GAS CYLINDER

(75) Inventors: William Chohfi; Jose Veiga Dias, both of Porto; Jose Portocarrero, Vila Do Conde, all of (PT)

(73) Assignee: Amtrol, Inc., West Warwick, RI (US)

( * ) Notice: Subject to any disclaimer, the term of this patent is extended or adjusted under 35 U.S.C. 154(b) by 0 days.

(21) Appl. No.: 09/558,535

(22) Filed: Apr. 26, 2000

Related U.S. Application Data

(60) Provisional application No. 60/181,376, filed on Feb. 9, 2000.

(51) Int. Cl.[7] ..... E17C 1/02; E17C 1/04; B65D 21/02

(52) U.S. Cl. ..... 220/23.91; 220/560.11; 220/581; 220/913; 206/0.6; 206/511

(58) Field of Search ..... 220/4.08, 4.09, 220/4.21, 23.91, 560.11, 567.2, 581, 913; 206/0.6, 503, 509, 511

(56) References Cited

U.S. PATENT DOCUMENTS

| | | | | | |
|---|---|---|---|---|---|
| 2,838,085 | A | * | 6/1958 | Beeler | 206/0.6 |
| 3,788,511 | A | * | 1/1974 | Marsh | 220/23.91 |
| 4,802,515 | A | * | 2/1989 | Pytryga | 220/23.91 |
| 4,905,855 | A | * | 3/1990 | Troiano et al. | 220/23.91 |
| 5,335,954 | A | | 8/1994 | Holub et al. | 294/31.2 |
| 5,829,629 | A | * | 11/1998 | Usher | 220/23.91 |
| 6,012,411 | A | * | 1/2000 | Hochbrueckner | 116/207 |

FOREIGN PATENT DOCUMENTS

| | | | |
|---|---|---|---|
| EP | 0 805 302 A1 | 11/1997 | F17C/1/00 |
| FR | 2 716 951 A1 | 9/1995 | F17C/1/04 |

* cited by examiner

*Primary Examiner*—David T. Fidei
(74) *Attorney, Agent, or Firm*—Fish & Neave; Brajesh Mohan

(57) ABSTRACT

A protective device for gas cylinders is provided that protects the body of the gas cylinder from damage, is light, does not affect the required heat exchange from the environment to the liquified gas within the gas cylinder and renders the gas cylinder assembly easier to stack for safe storage. The protective device in accordance with the principles of the invention comprises a top part and a bottom part forming a cavity within which the gas cylinder is placed. In accordance with an illustrative embodiment of the invention, the top part and bottom part are both made of synthetic materials and are interconnected during assembling process by a standard functional clipping device. These clippings may be broken in order for the protective device to be removed, allowing visual inspection of the gas cylinder without damaging the gas cylinder in the removal process.

13 Claims, 9 Drawing Sheets

FULL JACKET GAS CYLINDER

CROSS REFERENCE TO RELATED APPLICATIONS

This claims the benefit of copending, commonly-assigned U.S. Provisional Patent Application No. 60/181,316, filed Feb. 9, 2000.

BACKGROUND OF THE INVENTION

This invention relates to gas cylinders, and more particularly to an improved protective device for gas cylinders.

Known designs for gas cylinder protectors comprise top and bottom steel rings welded to the resistant part of a gas cylinder. While the top ring acts as a valve protection device and has built in handles for carrying purposes, the bottom ring acts as a stand.

Typically, gas cylinders are intended for multiple uses within a deposit and return system. In order for a gas cylinder to be reprocessed, the welded top and bottom rings may have to be separated during maintenance of the gas cylinder. Generally, in accordance with the laws of the country of usage, maintenance and re-testing operations are required every ten to fifteen years. Meanwhile, the cylinder is periodically checked when it arrives at the filling station to be refilled. This checking may occur three or four times a year. In accordance with the findings of this checking, it may be decided that the gas cylinder be refurbished. In known designs, the body of the gas cylinder is often damaged in this separation process, causing the entire unit to be scrapped.

Moreover, while the top ring and the bottom ring provide protection to the valve and the bottom part of the gas cylinder, respectively, the sides of the gas cylinder are still left exposed to various environmental conditions that may detrimentally affect the gas cylinder. A further disadvantage of the steel rings is its relative weight.

During its life cycle, gas cylinders are typically refilled several times and exposed to mechanical and chemical aggressions, mostly due to poor handling and severe storage conditions. Exposures of these kinds may cause mechanical deformation and rust leading to dangerous conditions.

Accordingly, steel cylinders are periodically submitted to legally enforced visual inspection and hydraulic pressure testing aimed at the steel resistant container. Depending on the level of damage detected, cylinders may either be scraped or submitted to refurbishment operations that may include the replacement of either the top or the bottom ring or both. As mentioned earlier, the body of the gas cylinder is often damaged in this replacement process, causing the entire unit to be scrapped.

Some known protector designs attempt to address the excessive weight problem associated with steel rings welded to the top and bottom of gas cylinders by molding a synthetic mold onto the gas cylinder such that the mold is intimately linked to the gas cylinder, thereby enclosing the gas cylinder. Although, the resulting protector is lighter than one having steel rings welded to the top and bottom of gas cylinders, this proposed solution, however, prevents the steel resistant part of the gas cylinders from visual inspection without major damage to the steel cylinder; this is so because removal of the molded plastic material linked to the steel cylinder is almost impossible without causing major damage to the steel cylinder.

Furthermore, although molding a synthetic onto the gas cylinder provides protection to the gas cylinder against shock, it does so at the expense of affecting the needed heat exchange from the environment to the liquified gas within the gas cylinder.

As would be appreciated from the above, it is important to provide a protective device for gas cylinders that protects the body of the gas cylinder from damage while being light.

In view of the foregoing, it is an object of the invention to provide a protective device for gas cylinders that protects the body of the gas cylinder from damage while being light.

It is another object of the invention to provide a protective device for gas cylinders that protects the body of the gas cylinder from damage, is light and allows for visual inspection of the gas cylinder without damaging the gas cylinder.

It is another object of the invention to provide a protective device for gas cylinders that protects the body of the gas cylinder from damage, is light and does not affect the required heat exchange from the environment to the liquified gas within the gas cylinder.

It is another object of the invention to provide a protective device for gas cylinders that protects the body of the gas cylinder from damage, is light, does not affect the required heat exchange from the environment to the liquefied gas within the gas cylinder and renders the gas cylinder assembly easier to stack for safe storage.

It is another object of the invention to provide a protective device for gas cylinders having ergonomic grips in the top part for handling purposes.

SUMMARY OF THE INVENTION

These and other objects of the invention are accomplished in accordance with the principles of the invention by providing a full jacket protective device for gas cylinders that protects the body of the gas cylinder from damage, is light, allows for visual inspection of the gas cylinder without causing damage to the gas cylinder, does not affect the required heat exchange from the environment to the liquified gas within the gas cylinder and renders the gas cylinder assembly easier to stack for safe storage.

In accordance with the principles of the invention, the full jacket protective device for gas cylinders is provided which provides protection against shock to the steel container and valve and incorporates the functional features of the stand (bottom ring) and the handle (top ring) of the resistant steel part.

The full jacket protective device built in accordance with the principles of the invention encloses the gas cylinder, thereby providing protection against shock and direct damage to the entire body of the gas cylinder and the valve without affecting the needed heat exchange from the environment to the liquefied gas within the steel part.

The protective device in accordance with the principles of the invention comprises a top part and a bottom part forming a cavity within which the gas cylinder is placed. In accordance with an illustrative embodiment of the invention, the top part and bottom part are both made of synthetic materials and are interconnected during assembling process by a standard functional clipping device. These clippings may be broken in order for the protective device to be removed, allowing visual inspection of the gas cylinder without damaging the gas cylinder in the removal process. After inspection, a new protective device can be easily assembled.

Furthermore, in an illustrative embodiment, the geometrical design of the top and bottom parts is such that the points at which the protective device makes contact with the body of the gas cylinder is minimized. In accordance with an illustrative embodiment of the invention, this is accomplished by having the walls of the top part and the bottom part wave apart from the wall of the gas cylinder enclosed, thereby generating channels that avoid heat insulation and contribute to absorb shock.

DETAILED DESCRIPTION OF THE PREFERRED EMBODIMENTS

Figure 1:
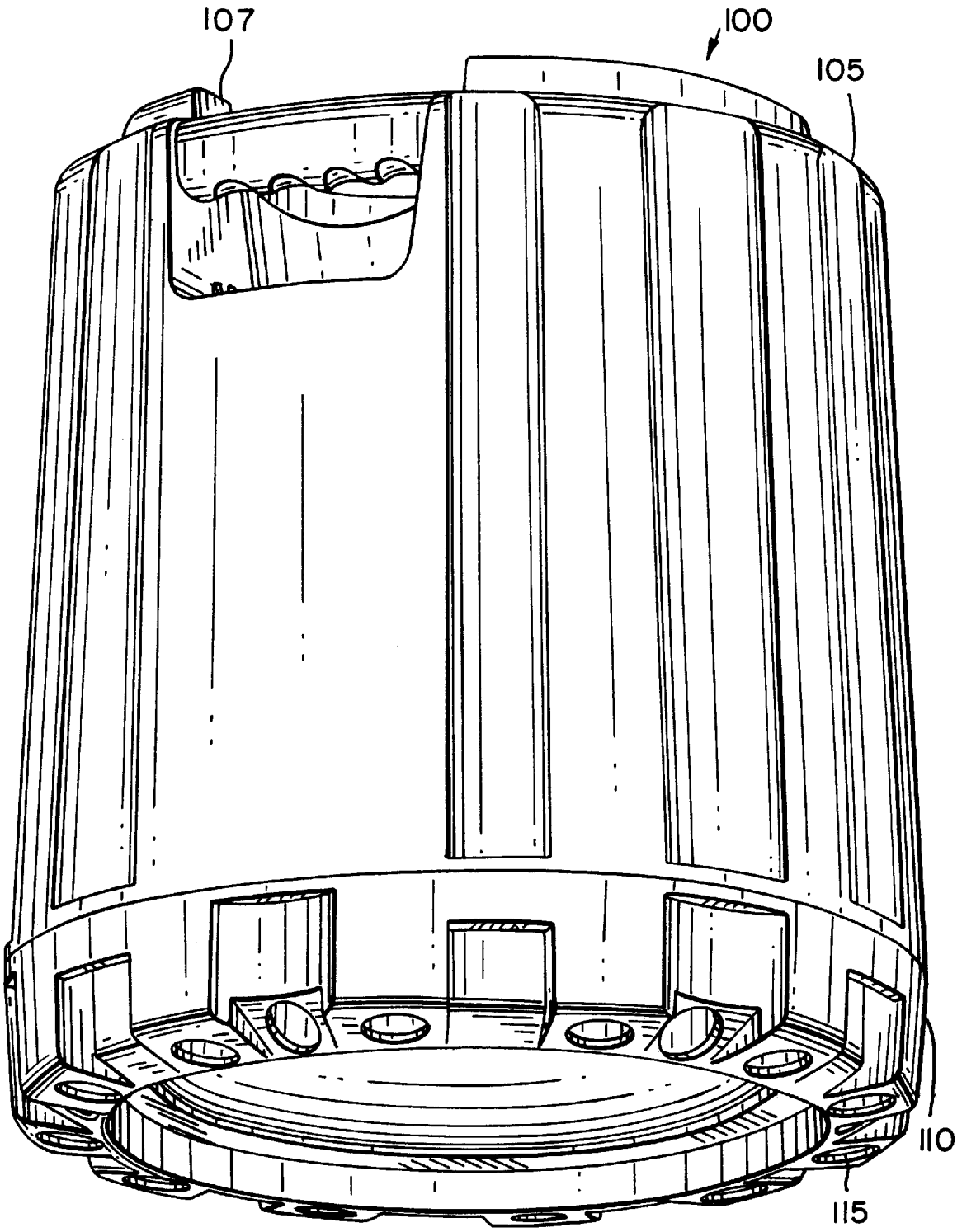
FIG. 1 is a perspective view of a full jacket protective device according to the present invention.

FIG. 1 is a perspective view of a full jacket protective device according to the present invention. Full jacket protective device 100 comprises of top part 105 and bottom part 110, respectively. Top part 105 has coupled to it ergonomic handles 107 for carrying the enclosed gas cylinder. After a gas cylinder is enclosed by top part 105 and bottom part 110, top part 105 and bottom part 110 are coupled together during assembly process by a standard functional clipping device. This process ensures that the gas cylinder is held securely in place and the full jacket protective device does not come apart.

As evident from FIG. 1, top part 105 and bottom part 110 have a wave-like structure. This wave-like structure ensures that the full jacket protective device encloses the gas cylinder, thereby protecting it against damage from shock without affecting the needed heat exchange from the environment to the liquified gas within the gas cylinder.

A specific problem encountered during longer consumption periods of gas is that the gas cylinder cools down to an extent that a drop in pressure is experienced due to inadequate evaporation of the liquefied gas. The wave-like shape of the full jacket protective device built in accordance with the principles of the invention addresses this problem. The wave-like shape ensures maximum exposure of the gas cylinder wall to atmospheric conditions, minimizing insulating materials between the gas cylinder and the environment and generating a convection driven air flow against the gas cylinder walls which contributes to the rate of exchange of thermal energy.

Figure 2:
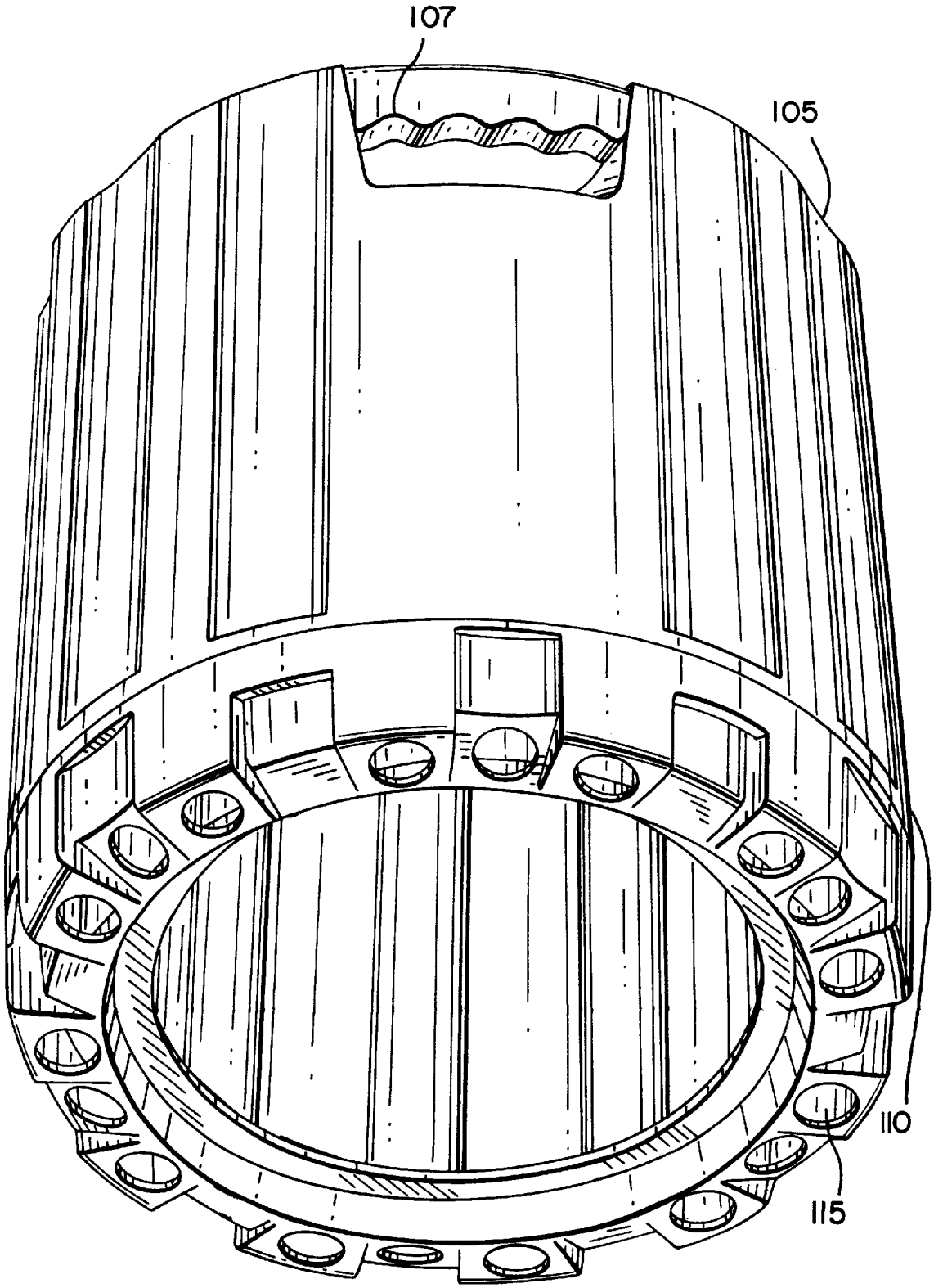
FIG. 2 is a view similar to that shown in FIG. 1, but focusing on the bottom part of the full jacket protective device according to the present invention.

Also shown in FIG. 1 are apertures 115 in bottom part 110 of full jacket protective device 100 for facilitating air flow even when the gas cylinder and the full jacket protective device are placed on ground or are stacked. Apertures 115 are more readily visible in FIG. 2.

Figure 3:
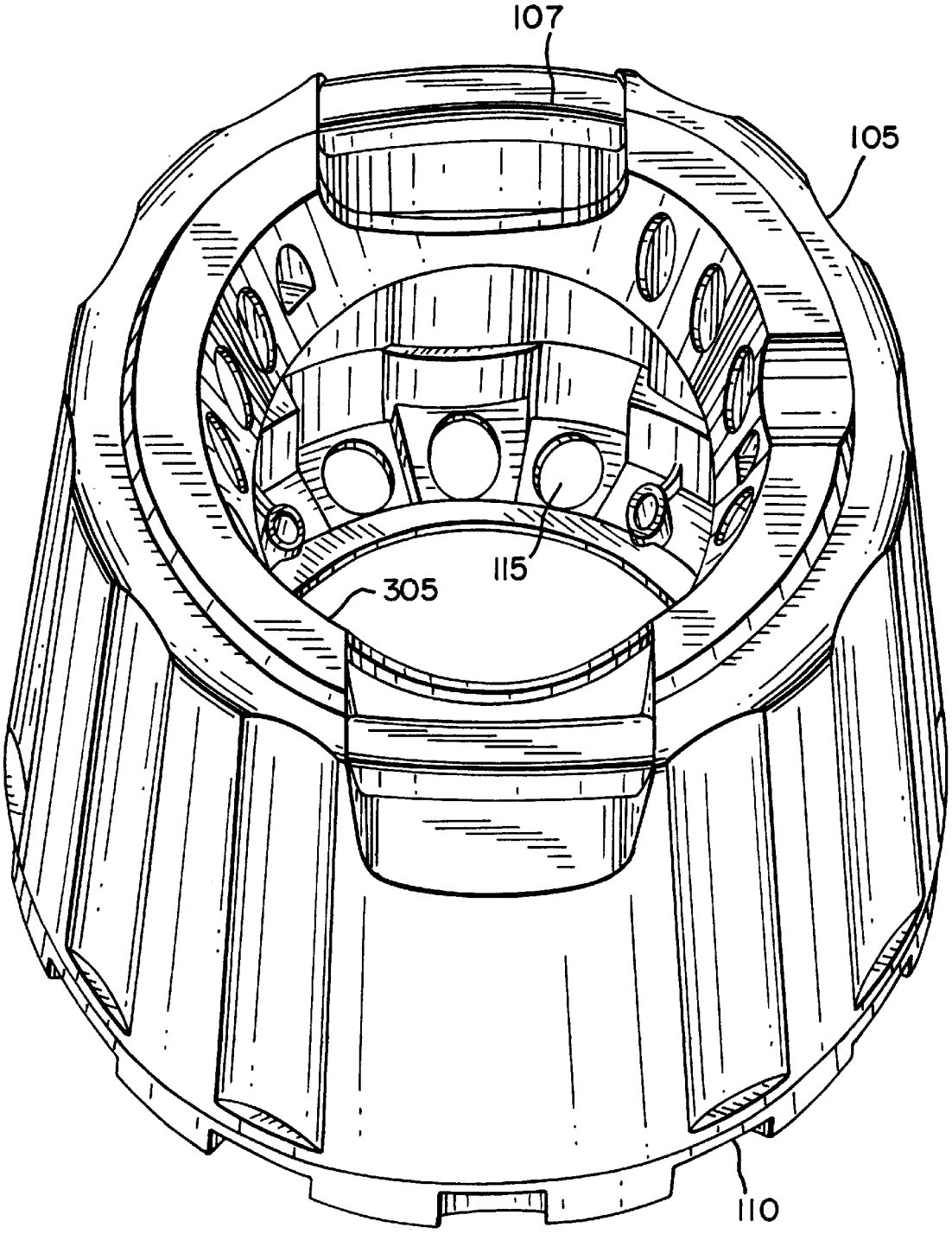
FIG. 3 is a view similar to that shown in FIG. 1, but focusing on the top part of the full jacket protective device according to the present invention.

FIG. 3 provides a view of apertures 115 when seen from top part 105 of full jacket protective device 100. Also shown in FIG. 3 is the access to the valve through an opening in top part 105 and stacking lips 305 used to stack one protective assembly housing a gas cylinder on top of another similar full jacket protective device.

Figure 4:
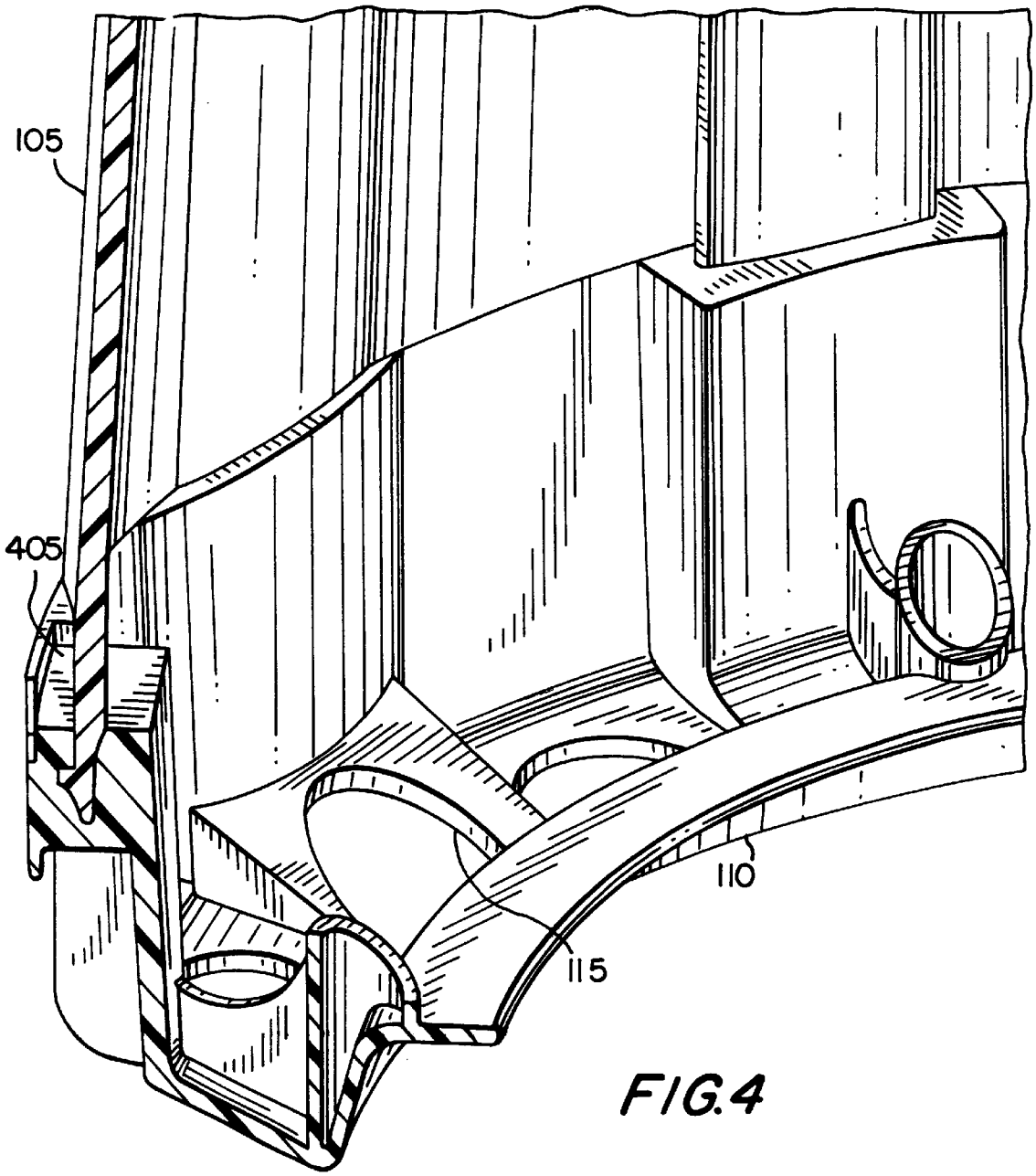
FIG. 4 is a sectional perspective view of the bottom part of the full jacket protective device showing a clipping system according to the present invention.

FIG. 4 is a sectional perspective view of the bottom part of the full jacket protective device showing a clipping system according to the present invention. Shown in FIG. 4 is a simplified representation of clipping system 405 used to secure top part 105 and bottom part 110 of full jacket protective device together to hold a corresponding gas cylinder in place. Although only one such clipping system is shown in FIG. 4, it will be understood that more than one of such clipping system may be displaced along the upper perimeter of bottom part 110 and the corresponding of top part 105. The clipping device of the clipping system can be destroyed to remove the protective device off the gas cylinder, allowing for visual inspection of the gas cylinder without damaging the steel cylinder. After visual inspection of the gas cylinder, a new protective device with intact clipping devices can be easily assembled in order to protect the gas cylinder.

It will be also understood that other means of clipping upper part 105 and bottom part 110 can be employed. In a preferred embodiment made in accordance with the principles of the invention, top part 105 and bottom part 110 are clipped together by at least 5 clipping systems.

Figure 5:
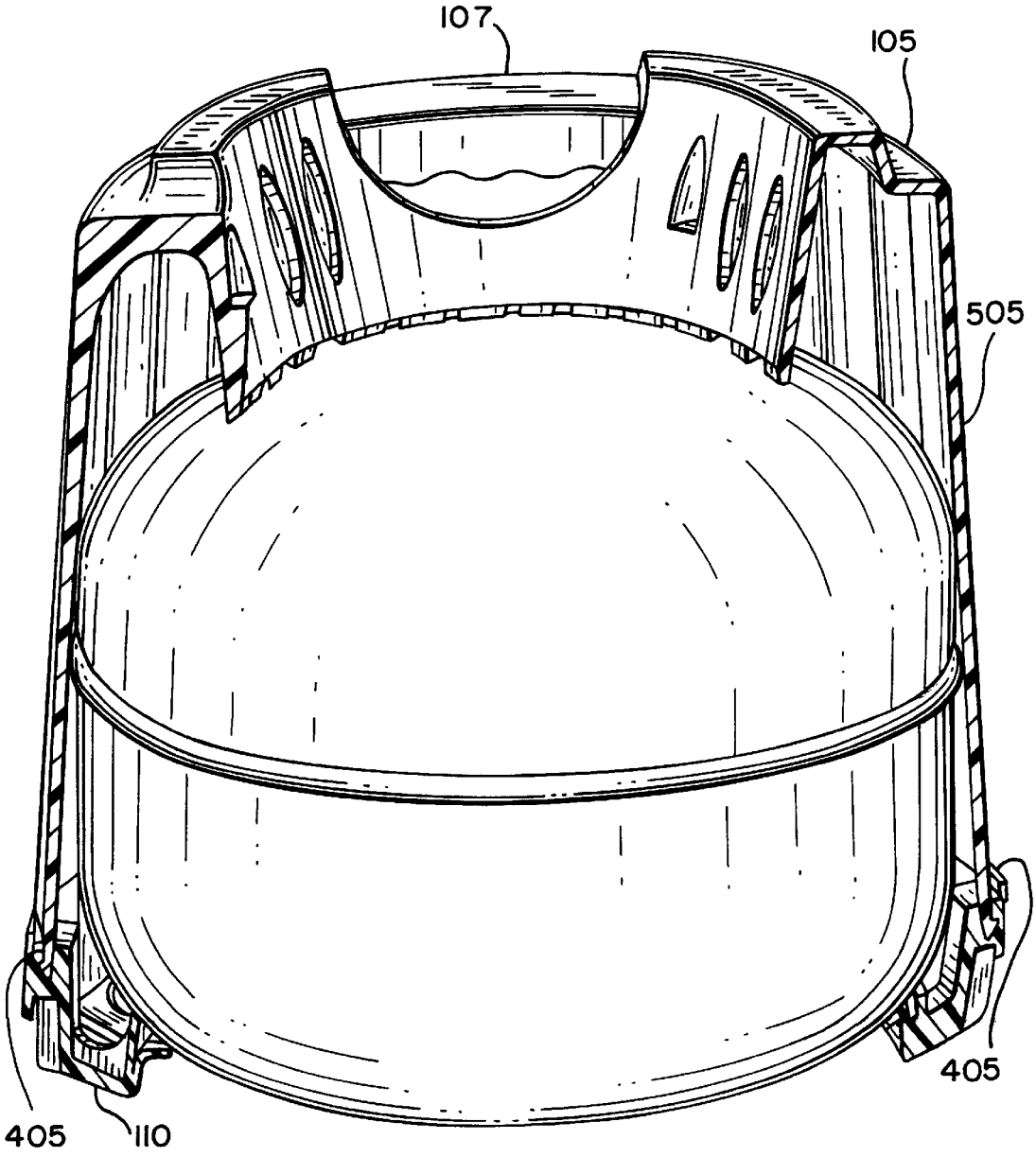
FIG. 5 is a sectional perspective view of the full jacket protective device enclosing a gas cylinder according to the present invention.

Shown in FIG. 5 is a sectional perspective view of the full jacket protective device enclosing gas cylinder 505 according to the present invention. Also shown in FIG. 5 is the sectional view of two clipping systems 405 in accordance with the principles of the invention.

Figure 6:
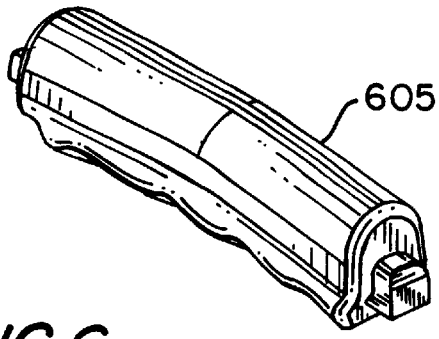
FIG. 6 is a perspective view of an handle made in accordance with an illustrative embodiment of the present invention.

Shown in FIG. 6 is a perspective view of handle 605 made in accordance with an illustrative embodiment of the present invention.

Figure 7:
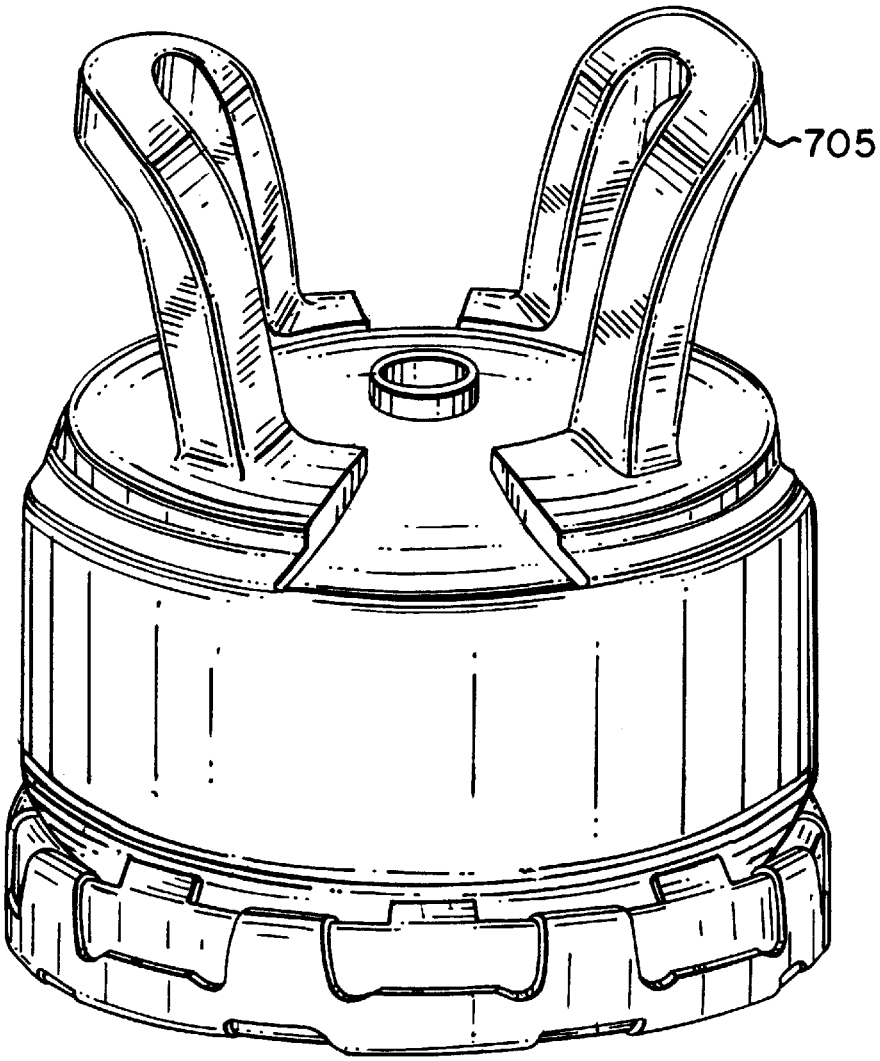
FIG. 7 is a perspective view of an handle made in accordance with another illustrative embodiment of the present invention.

Shown in FIG. 7 is a perspective view of an handle made in accordance with another illustrative embodiment of the present invention. Handle 705 resembles rabbit ears in appearance. Handle 705 is uniquely secured to a welded metal portion (not shown) welded onto the top portion of the gas cylinder. Handle 705 provides ergonomic grips for handling purposes. It will be appreciated that an ergonomic design of the handle is very desirable in that it assists in the transportation of the gas cylinder.

Similarly, it will also be appreciated that a comfortable grip would additionally assist in the efficient handling of the gas cylinder. Thus, in accordance with the principles of this invention, the surface of handle 705 that makes contact with a user's hands during lifting of the gas cylinder is constructed of a soft and cushy pliable material, e.g., rubber. This feature of the invention can be achieved using standard molding techniques, e.g., double injection molding. It will, however, be understood that handle 705 may also be constructed such that the soft and cushy pliable material may only be present in the lower gripping part of handle 705, or any other desirable part of handle 705.

Figure 8:
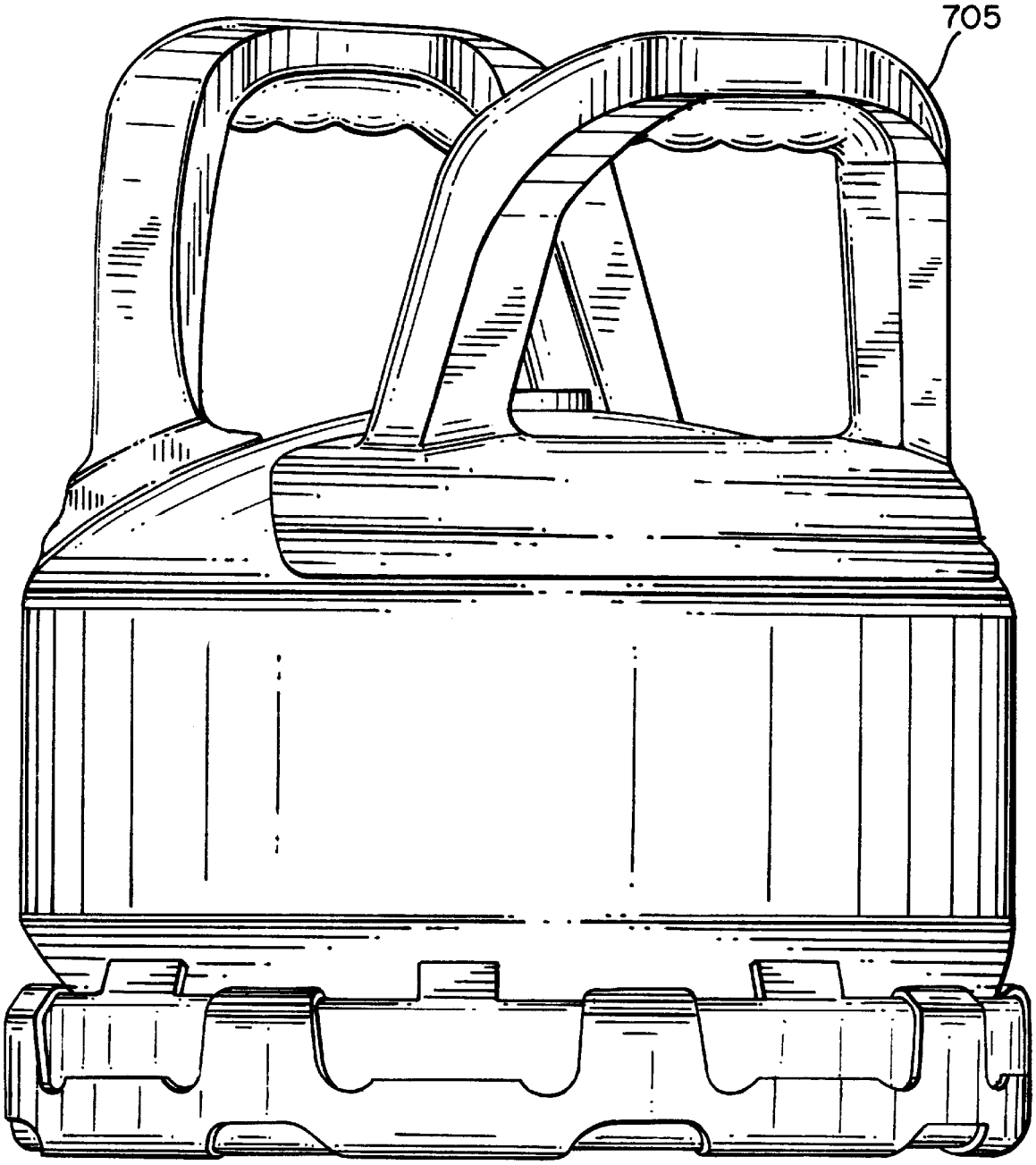
FIG. 8 is yet another perspective view of the handle shown in FIG. 7 according to the present invention.
Figure 9:
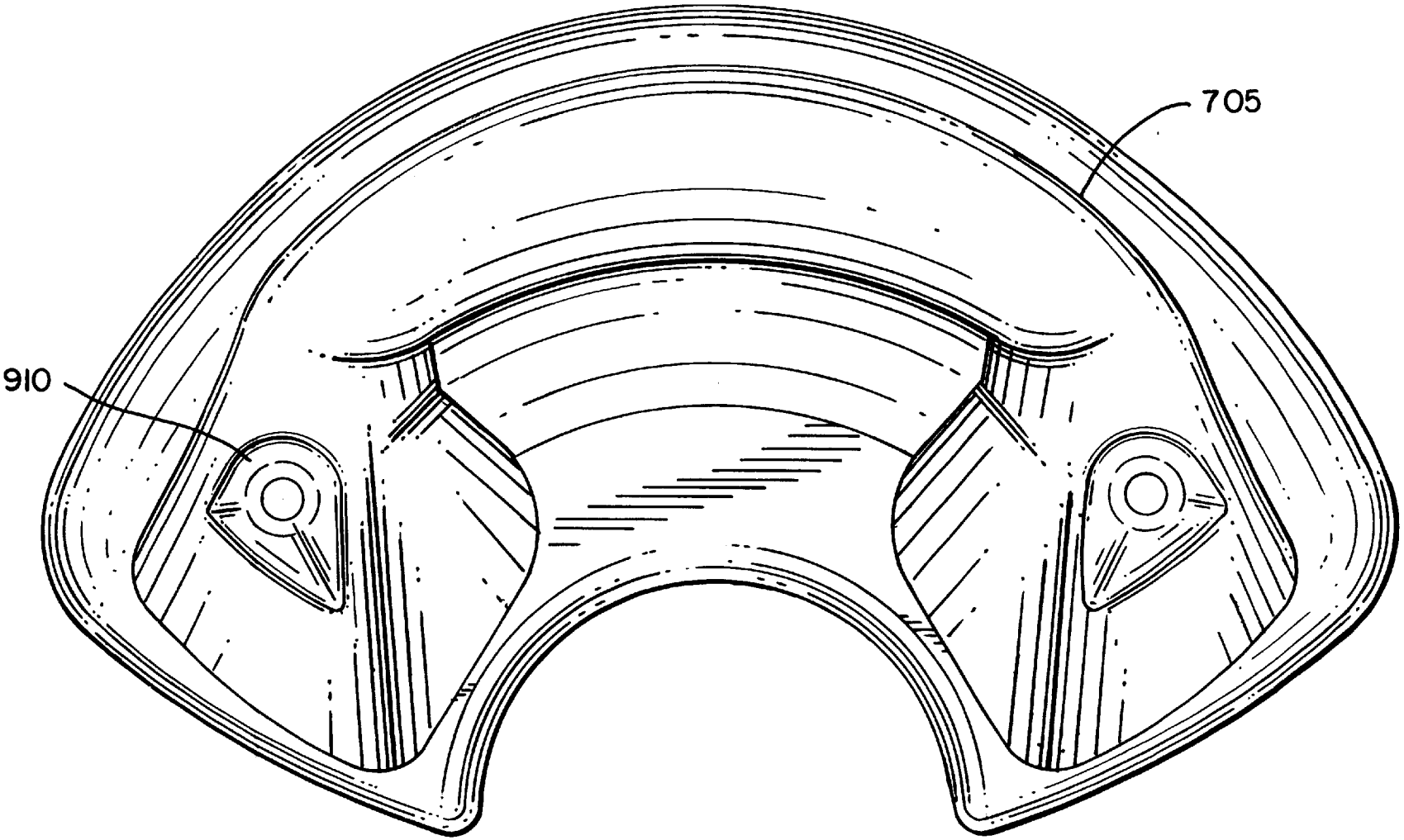
FIG. 9 is yet another perspective view of the handle shown in FIG. 7 according to the present invention.

FIGS. 8 and 9 also illustrate perspective views of the handle shown in FIG. 7 according to the present invention. As illustrated in FIG. 9, handle 705 is bolted to welded metal portion (not shown) by bolting device 910. The welded portion, in turn, is welded onto the top portion of the gas cylinder. In a preferred embodiment, there are two handles secured to respective pairs of welded metal portions.

Figure 10:
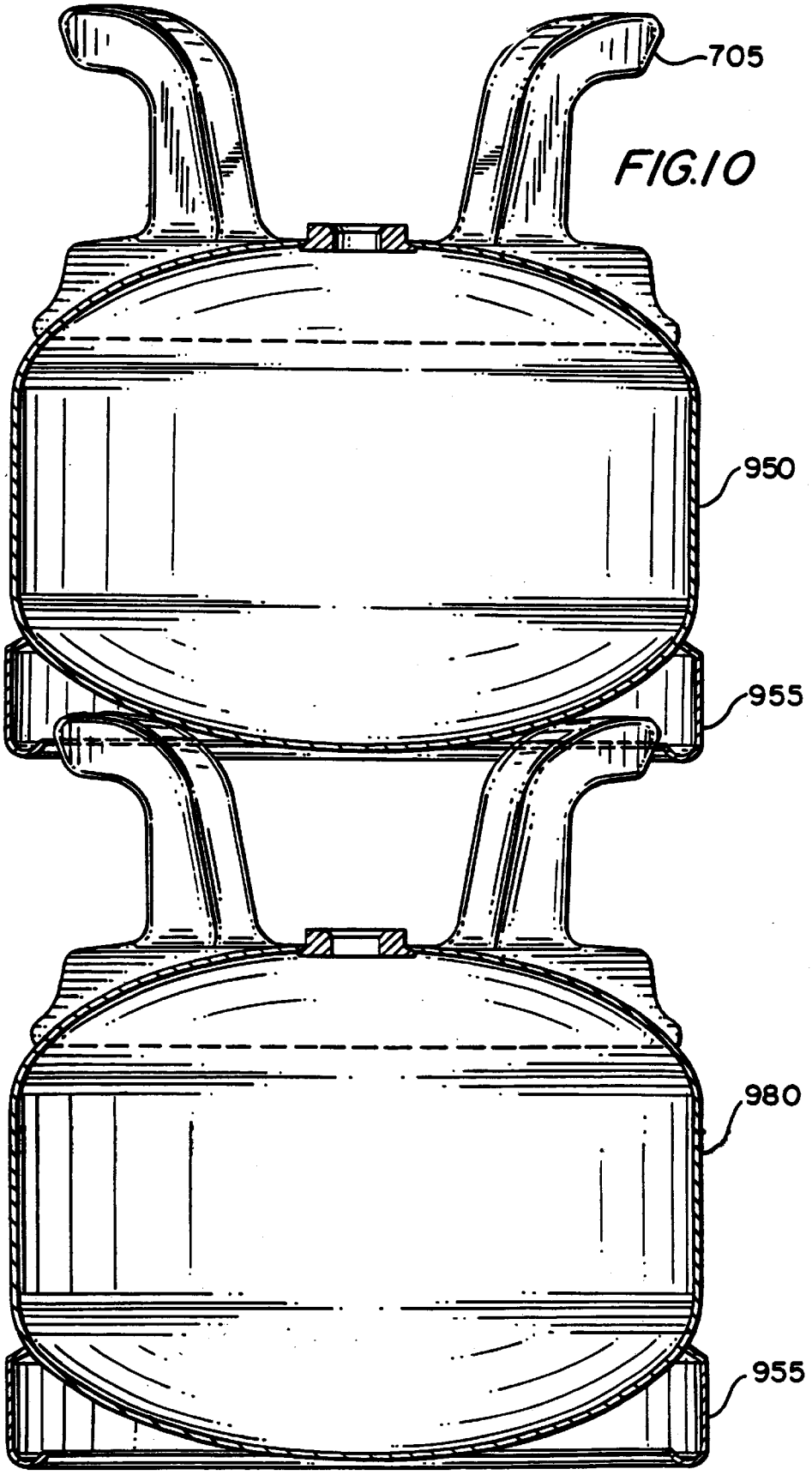
FIG. 10 is an elevation view showing stacking of two cylinders having handles of the kind shown in FIG. 7.

FIG. 10 is an elevation view showing stacking of two cylinders 950 and 980, respectively, having handles of the kind shown in FIGS. 7, 8 and 9. As illustrated in FIG. 10, bottom part 955 of the protective device is constructed in order to accommodate rabbit ears 705 of the cylinder beneath, when one cylinder is stacked on top another. It will, however, be understood that bottom part 955 of a protective device built in accordance with the principles of this inventions can be configured to accommodate handles of different configurations to facilitate stacking of cylinders.

It will also be understood that the foregoing is only illustrative of the principles of the invention, and that various modifications can be made by those skilled in the art without departing from the scope and spirit of the invention. The described embodiments are presented for the purpose of illustration rather than limitation. Accordingly, it is intended to embrace all such alternatives, modifications and variations as fall within the spirit of the appended claims.

What is claimed is:

1. A protective device for housing a gas cylinder comprising:

a top part having an upper opening and a lower opening, wherein a plurality of first openings are circumferentially dispersed around said upper opening of said top part; and a bottom part having an upper opening and a lower opening, said upper opening of the bottom part removably coupled to the lower opening of the top part enclosing the gas cylinder and wherein a plurality of second openings are circumferentially dispersed around said lower opening of said bottom part, wherein area external to the upper opening of the top part is in fluid communication with area external to the lower opening of the bottom part through said plurality of first and second openings through the protective device's interior while the gas cylinder is enclosed within the protective device.

2. The protective device of claim 1 wherein the top part has a substantially cylindrical body having an inner undulated surface with longitudinally oriented contact surfaces that make contact with the gas cylinder's body, said contact surfaces are interposed between longitudinally oriented non-contacting surfaces, wherein said longitudinally oriented contact surfaces and said longitudinally oriented non-contacting surfaces collectively form the inner undulated surface.

3. The protective device of claim 1 wherein the top part has an inwardly tapering portion having circumferentially dispersed openings for providing fluid communication between area interior to the protective device and area external to the protective device.

4. The protective device of claim 3 wherein the inwardly tapering portion allows access to handles mounted on the gas cylinder.

5. The protective device of claim 1 wherein the bottom part has a substantially cylindrical body having an inner undulated surface with longitudinally oriented contact surfaces that make contact with the gas cylinder's body, said contact surfaces are interposed between longitudinally oriented non-contacting surfaces, wherein said longitudinally oriented contact surfaces and said longitudinally oriented non-contacting surfaces collectively form the inner undulated surface.

6. The protective device of claim 5 wherein said contact surfaces and said non-contacting surfaces of the bottom part are in alignment with corresponding surfaces of the top part when the lower opening of the top part is removably coupled to the upper opening of the bottom part enclosing the gas cylinder.

7. The protective device of claim 6 wherein said fluid communication is provided by passage of air between the first openings and corresponding second openings through the non-contacting surfaces.

8. The protective device of claim 7 wherein the base portion has an inwardly projecting grove portion.

9. The protective device of claim 8 wherein the top part has an outwardly projecting lip portion.

10. The protective device of claim 8 wherein the lip portion of the top part is configured to conform to the inwardly projecting grove portion of the base portion allowing stacking of gas cylinders.

11. The protective device of claim 1 wherein the bottom part is configured to accommodate handles mounted on gas cylinders while stacking cylinders.

12. The protective device of claim 1 wherein said top part and said bottom part comprise synthetic materials.

13. The protective device of claim 1 wherein the lower opening of the top part is removably coupled to the upper opening of the bottom part using a clipping device.

* * * * *